US009323179B2

(12) United States Patent
Shimizu et al.

(10) Patent No.: US 9,323,179 B2
(45) Date of Patent: Apr. 26, 2016

(54) DEVELOPING UNIT AND IMAGE FORMING APPARATUS

(71) Applicant: KYOCERA Document Solutions Inc., Osaka (JP)

(72) Inventors: Tamotsu Shimizu, Osaka (JP); Shizuka Okada, Osaka (JP); Takefumi Yotsutsuji, Osaka (JP); Akifumi Yamaguchi, Osaka (JP)

(73) Assignee: KYOCERA DOCUMENT SOLUTIONS INC., Osaka (JP)

( * ) Notice: Subject to any disclaimer, the term of this patent is extended or adjusted under 35 U.S.C. 154(b) by 1 day.

(21) Appl. No.: 14/156,162

(22) Filed: Jan. 15, 2014

(65) Prior Publication Data

US 2014/0205325 A1 Jul. 24, 2014

(30) Foreign Application Priority Data

Jan. 18, 2013 (JP) ..... 2013-007372

(51) Int. Cl.
*G03G 15/08* (2006.01)

(52) U.S. Cl.
CPC ..... *G03G 15/0893* (2013.01); *G03G 15/0812* (2013.01)

(58) Field of Classification Search
CPC ..... G03G 15/0891; G03G 15/089; G03G 15/0893; G03G 15/09143; G03G 15/0914
USPC ..... 399/254, 256, 267, 272
See application file for complete search history.

(56) References Cited

U.S. PATENT DOCUMENTS

| | | | | |
|---|---|---|---|---|
| 5,124,752 | A * | 6/1992 | Kanno et al. | 399/53 |
| 6,249,664 | B1 | 6/2001 | Sato | |
| 2002/0012551 | A1* | 1/2002 | Tsutsui et al. | 399/252 |
| 2004/0265014 | A1* | 12/2004 | Takeuchi et al. | 399/274 |
| 2012/0251185 | A1* | 10/2012 | Matsumoto | 399/258 |

FOREIGN PATENT DOCUMENTS

| | | | |
|---|---|---|---|
| JP | 2000-019822 | | 1/2000 |
| JP | 2005099564 | A * | 4/2005 |

OTHER PUBLICATIONS

JP 2005099564 English translation, Sato et al., Apr. 14, 2005.*

* cited by examiner

*Primary Examiner* — David Gray
*Assistant Examiner* — Thomas Giampaolo, II
(74) *Attorney, Agent, or Firm* — Knobbe, Martens Olson & Bear LLP

(57) ABSTRACT

A developing unit includes a casing, a developer carrier, a developer conveying path, a developer conveying member, and a layer thickness regulator. The developer carrier is driven to rotate in the casing and carries a toner on the circumferential surface. The developer conveying member is located in the developer conveying path and driven to rotate so as to convey the developer in a second direction and to supply the toner to the developer carrier. The layer thickness regulator is spaced from the developer carrier, and regulates a layer thickness of the developer supplied to the developer carrier. The developing unit is configured to satisfy a condition of $2.0<Vd/Vs<7.0$, where Vd denotes a circumferential velocity of the developer carrier and Vs denotes a circumferential velocity of the developer conveying member.

4 Claims, 5 Drawing Sheets

DEVELOPING UNIT AND IMAGE FORMING APPARATUS

INCORPORATION BY REFERENCE

This application claims priority to Japanese Patent Application No. 2013-007372 filed on 18 Jan. 2013, the entire contents of which are incorporated by reference herein.

BACKGROUND

1. Technical Field

The present disclosure relates to a developing unit that develops a static latent image formed on an image carrier by using a two-component developer, and an image forming apparatus including the developing unit.

2. Related Art

Developing units thus far developed for use in an image forming apparatus such as a printer, to develop a static latent image formed on an image carrier by using a two-component developer, include those having a developer carrier including therein a fixed magnet, a layer thickness regulator that controls the thickness of the developer layer formed on the developer carrier, and a developer conveying member that supplies the developer to the developer carrier.

In such a developing unit, the circumferential velocity of the developer carrier is set so as not to exceed twice of the circumferential velocity of the developer conveying member, in order to prevent degradation of image quality originating from improper supply of the developer from the developer conveying member to the developer carrier.

SUMMARY

In an aspect, the disclosure proposes further improvement of the foregoing technique.

The disclosure proposes a developing unit including a casing, a developer carrier, a developer conveying path, a developer conveying member, and a layer thickness regulator.

The casing stores therein a two-component developer containing a toner and a carrier.

The developer carrier is located in the casing and includes a shaft portion. The developer carrier is configured to be driven to rotate and to carry the developer on a circumferential surface of the developer carrier.

The developer conveying path is located in the casing, and includes a first conveying path spaced from the developer carrier and configured to convey the developer in a first direction, and a second conveying path located between the developer carrier and the first conveying path and configured to convey the developer in a second direction opposite to the first direction. The developer conveying path is configured to circulate the developer between the first conveying path and the second conveying path.

The developer conveying member is located in the second conveying path so as to oppose the developer carrier, and configured to be driven to rotate in a direction opposite to a rotating direction of the developer carrier in a region where the respective circumferential surfaces of the developer conveying member and the developer carrier are opposed to each other, so as to convey the developer in the second direction and to supply the developer to the developer carrier.

The layer thickness regulator is spaced from the circumferential surface of the developer carrier, and configured to regulate a layer thickness of the developer supplied to the developer carrier.

The developing unit is configured to satisfy a condition of $2.0<Vd/Vs<7.0$, where Vd denotes a circumferential velocity of the developer carrier and Vs denotes a circumferential velocity of the developer conveying member.

In another aspect, the disclosure provides an image forming apparatus including the foregoing developing unit, an image carrier, and a transfer unit.

The image carrier is configured to carry a static latent image formed on a surface thereof.

The developing unit is configured to develop the static latent image formed on the surface of the image carrier to thereby form a toner image.

The transfer unit is configured to transfer the toner image formed on the surface of the image carrier onto a sheet.

DETAILED DESCRIPTION

Figure 1:
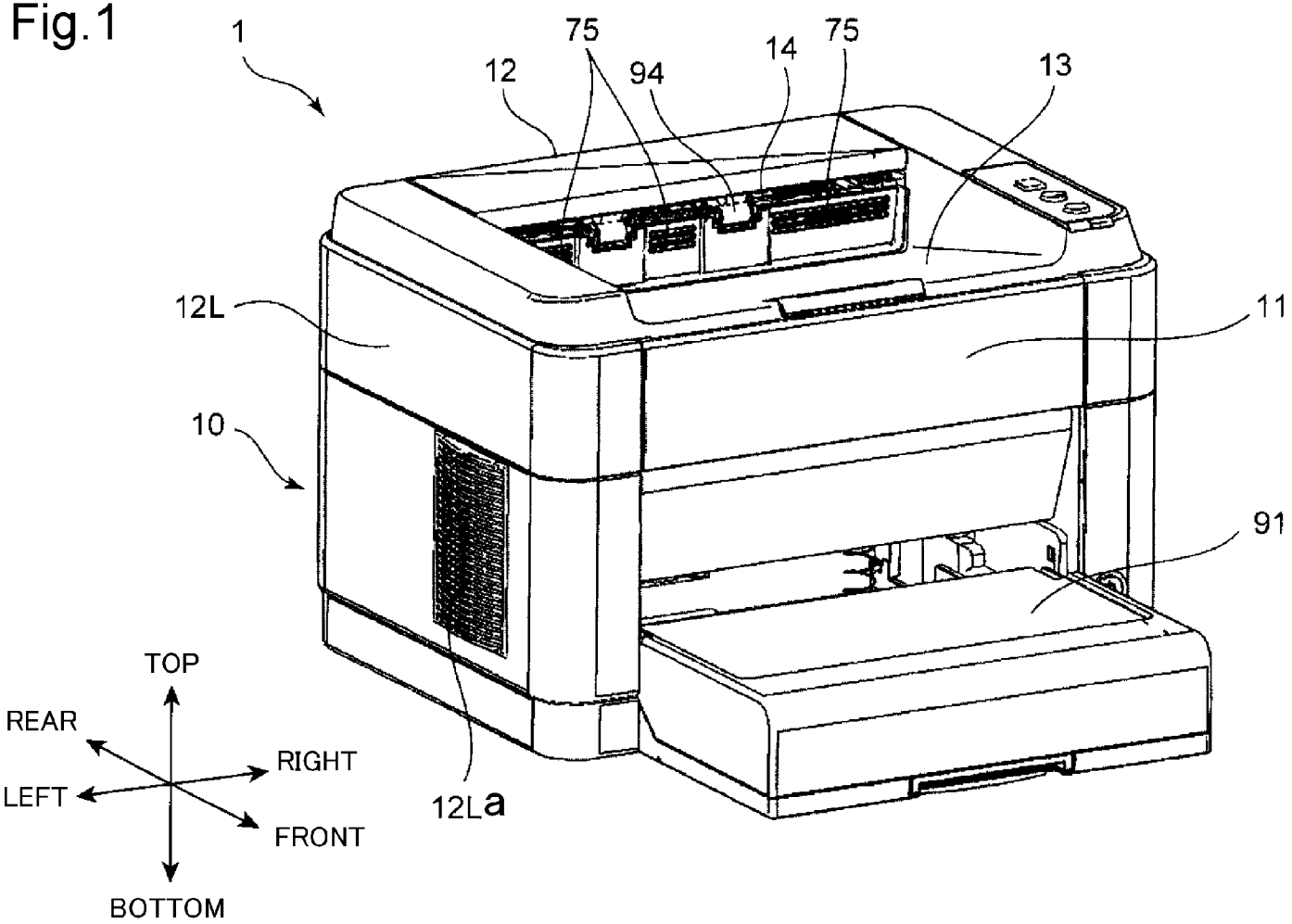
FIG. 1 is a perspective view showing the appearance of an image forming apparatus according to an embodiment of the disclosure.
Figure 2:
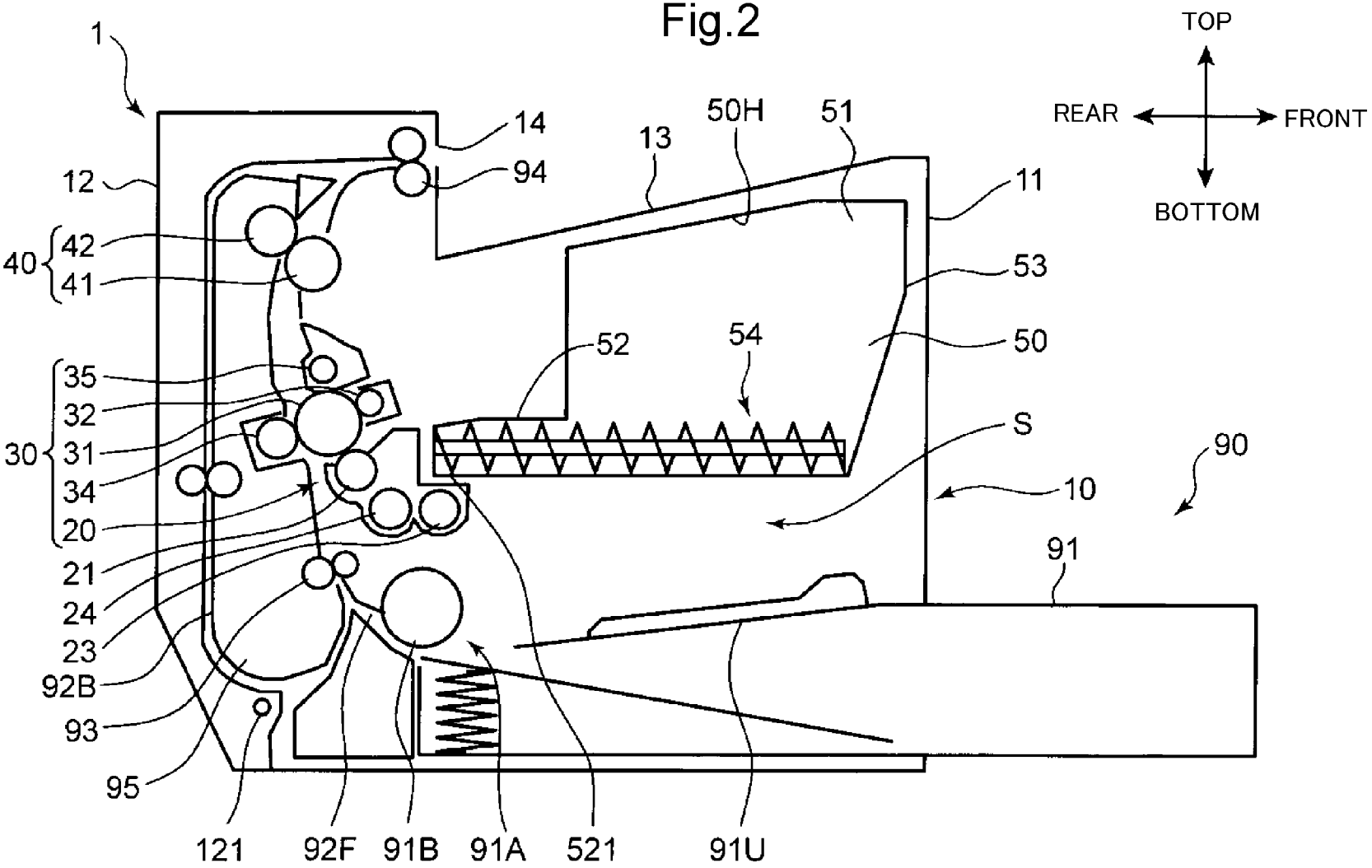
FIG. 2 is a cross-sectional view showing the internal structure of the image forming apparatus according to the embodiment.

Hereafter, an embodiment of the disclosure will be described in details, referring to the drawings. FIG. 1 is a perspective view showing the appearance of an image forming apparatus according to the embodiment of the disclosure. FIG. 2 is a cross-sectional view showing the internal structure of the image forming apparatus according to the embodiment. In this embodiment the image forming apparatus 1 is exemplified by a monochrome printer, however the image forming apparatus may be a copier, a facsimile machine, or a multifunction peripheral having the functions of those apparatuses, or an apparatus configured to form color images.

The image forming apparatus 1 includes a main body housing 10 of a generally rectangular block shape and serving as a casing, an image forming unit 30 installed inside the main body housing 10, a fixing unit 40, a toner container 50, and a paper feed unit 90.

The main body housing 10 includes a front cover 11 and a rear cover 12 respectively located on the front face and the rear face. When the front cover 11 is opened, the toner container 50 is exposed on the front face, so that a user can draw out the toner container 50 from the main body housing 10 through the front face, for example when the toner runs out. The rear cover 12 is opened in the event of sheet jam or when maintenance work is to be performed. The image forming unit 30 and the fixing unit 40 can be drawn out through the rear face of the main body housing 10 upon opening the rear cover 12. The main body housing 10 also includes a left cover 12L (see FIG. 1) and a right cover 12R (unseen in FIG. 1) opposite to the left cover 12L, respectively extending in a vertical direction on the side faces of the main body housing 10. The left cover 12L includes an air inlet 12La located in a forward portion thereof, for introducing air into the main body housing 10. In addition, an output area 13, where a sheet on which an image has been formed is discharged, is provided on the upper face of the main body housing 10. Inside of an internal space S (see FIG. 2) defined by the front cover 11, the rear cover 12, the left cover 12L, the right cover 12R, and the output area 13, components for forming an image are mounted.

The image forming unit 30 forms a toner image on the sheet delivered from the paper feed unit 90. The image forming unit 30 includes a photoconductor drum 31 (image carrier), and a charging unit 32, an exposure unit (not shown in FIG. 2), a developing unit 20, a transfer roller 34 (transfer unit), and a cleaning unit 35, all disposed around the photoconductor drum 31. The image forming unit 30 is located between the left cover 12L and the right cover 12R.

The photoconductor drum 31 includes a rotary shaft and a cylindrical surface set to rotate about the rotary shaft. A static latent image is formed on the cylindrical surface, and a toner image formed based on the static latent image is carried by the cylindrical surface. The photoconductor drum 31 may be constituted of, for example, an amorphous silicon (a-Si)-based material.

The charging unit 32 includes a charging roller disposed in contact with the photoconductor drum 31, and serves to uniformly charge the surface of the photoconductor drum 31.

The cleaning unit 35 includes a non-illustrated cleaning blade to remove the toner stuck to the circumferential surface of the photoconductor drum 31 after a toner image is formed, and conveys the removed toner to a non-illustrated recovery unit.

The exposure unit includes a laser source and optical devices such as mirrors and lenses, and configured to emit a laser beam modulated according to image data provided by an external device such as a personal computer onto the circumferential surface of the photoconductor drum 31, to thereby form a static latent image. The developing unit 20 supplies the toner to the circumferential surface of the photoconductor drum 31 to develop the static latent image on the photoconductor drum 31 thus to form a toner image. The developing unit 20 includes a developing roller 21 that carries the toner to be supplied to the photoconductor drum 31, and a first conveying screw 23 and a second conveying screw 24 that stir and circulate a developer inside of a developing unit housing 210 (see FIG. 3). Further details of the developing unit 20 according to this embodiment will be subsequently described.

The transfer roller 34 serves to transfer the toner image formed on the circumferential surface of the photoconductor drum 31 onto a sheet. The transfer roller 34 is disposed so as to contact the cylindrical surface of the photoconductor drum 31, and thus forms a transfer nip region. A transfer bias of a polarity reverse to that of the toner is applied to the transfer roller 34.

The fixing unit 40 is configured to fix the transferred toner image onto the sheet. The fixing unit 40 includes a fixing roller 41 having a heat source provided therein, and a pressure roller 42 pressed against the fixing roller 41 to form a fixing nip region between the fixing roller 41 and the pressure roller 42. When the sheet to which the toner image has been transferred is passed through the fixing nip region, the toner image is fixed onto the sheet with the heat of the fixing roller 41 and the pressure of the pressure roller 42.

The toner container 50 stores therein the toner to be refilled in the developing unit 20. The toner container 50 includes a container body 51 serving as the primary portion for storing the toner, a tubular portion 52 projecting from a lower portion of a side face of the container body 51, a cover 53 covering the opposite side face of the container body 51, and a rotary member 54 provided inside of the container to convey the toner. The toner stored in the toner container 50 is supplied, when the rotary member 54 is driven to rotate, to the developing unit 20 through a toner outlet 521 provided in the lower face of the tip portion of the tubular portion 52. A container top plate 50H covering the upper face of the toner container 50 is provided below the output area 13 (see FIG. 2).

The paper feed unit 90 includes a paper feed cassette 91 (see FIG. 2), in which the sheet to undergo the image forming process is placed. A portion of the paper feed cassette 91 sticks out further forward from the front side of the main body housing 10. The upper face of the portion of the paper feed cassette 91 located inside of the main body housing 10 is covered with a cassette top plate 91U. The paper feed cassette 91 includes a sheet space in which a bundle of the sheet is placed, and a lifting plate that lifts up the sheet bundle for sequentially feeding the sheets. A sheet delivery unit 91A is provided above the rear end portion of the paper feed cassette 91. The sheet delivery unit 91A includes a feed roller 91B that delivers the topmost one of the sheets in the paper feed cassette 91, one after another.

The main body housing 10 includes a main conveying path 92F and a reverse conveying path 92B through which the sheet is transported. The main conveying path 92F extends from the sheet delivery unit 91A of the paper feed unit 90 to a sheet outlet 14 opposed to the output area 13 on the upper face of the main body housing 10, through the image forming unit 30 and the fixing unit 40. The reverse conveying path 92B is utilized in the case of duplex printing, to return the sheet that has undergone the printing on one face to the upstream side of the image forming unit 30, in the main conveying path 92F.

The main conveying path 92F is configured to guide the sheet so as to pass the transfer nip region between the photoconductor drum 31 and the transfer roller 34, from the lower side to the upper side. A resist roller pair 93 is provided upstream of the transfer nip region, in the main conveying path 92F. The sheet is temporarily held by the resist roller pair 93, and delivered to the transfer nip region at a predetermined time point after skew correction is performed. A plurality of transport rollers is provided at appropriate positions of the main conveying path 92F and the reverse conveying path 92B. For example, a discharge roller pair 94 is provided in the vicinity of the sheet outlet 14.

The reverse conveying path 92B is defined between the outer face of a reversing unit 95 and the inner wall of the rear cover 12 of the main body housing 10. On the inner face of the reversing unit 95, the transfer roller 34 and one of the resist roller pair 93 is mounted. The rear cover 12 and the reversing unit 95 are each configured to pivot about a fulcrum 121 provided at a lower end portion of the rear cover 12 and the reversing unit 95. In case that sheet jam takes place in the reverse conveying path 92B, the rear cover 12 is opened. In case that sheet jam takes place in the main conveying path 92F, or when the unit including the photoconductor drum 31 or the developing unit 20 is to be removed, both the rear cover 12 and the reversing unit 95 are opened.

Developing Unit

Figure 3:
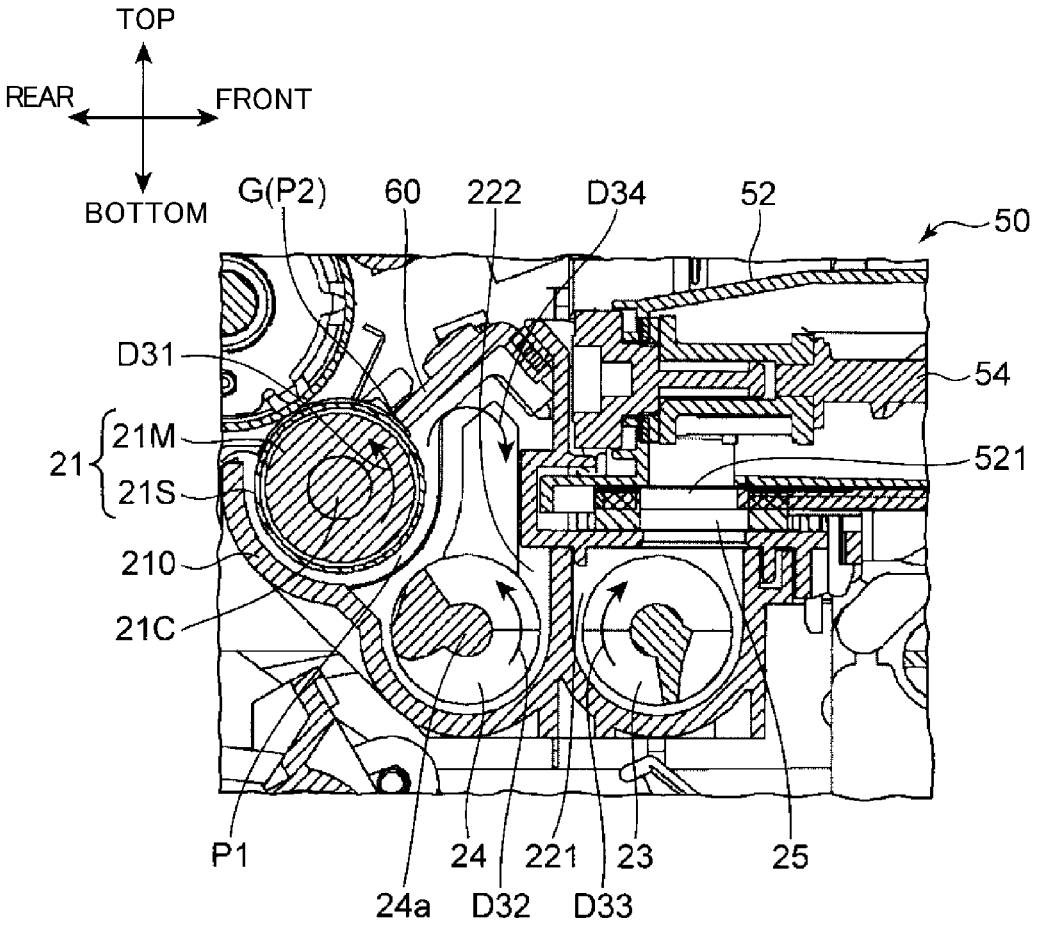
FIG. 3 is a cross-sectional view of a developing unit according to the embodiment.
Figure 4:
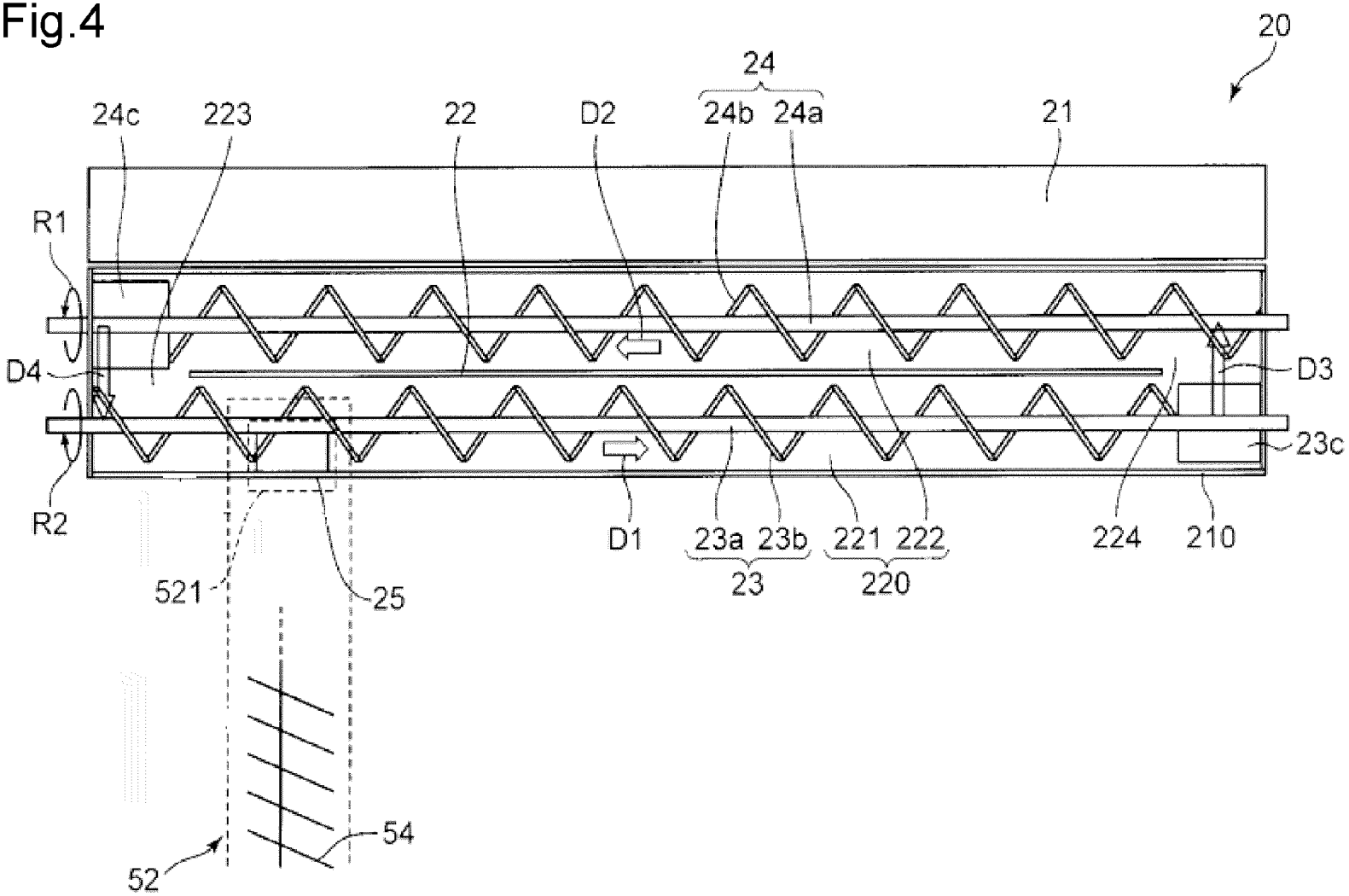
FIG. 4 is a plan view showing a part of the developing unit according to the embodiment.

The developing unit 20 according to this embodiment will now be described in details. FIG. 3 is a cross-sectional view showing the internal structure of the developing unit 20. FIG. 4 is a plan view showing the internal structure of the developing unit 20. The developing unit 20 includes a developing unit housing 210 (casing) of a box shape having a longitudinal side extending in one direction (axial direction of the developing roller 21). The developing unit housing 210 has an internal space 220. The developing roller 21 (developer carrier), the first stirring screw 23 and the second stirring screw 24 (developer conveying member), and a toner inlet 25 are provided in the internal space 220. In this embodiment, the developer containing a non-magnetic toner and a magnetic toner is stored in the internal space 220, to perform two-component development. The developer is conveyed inside of the internal space 220 while being stirred, and the toner is sequentially supplied from the developing roller 21 to the photoconductor drum 31, to develop the static latent image.

The developing roller 21 has a cylindrical shape extending in the longitudinal direction of the developing unit housing 210. The developing roller 21 includes a shaft portion 21C, a cylindrical sleeve 21S to be driven to rotate, and a column-shaped magnet 21M fixed inside of the sleeve 21S so as to extend in the axial direction. The sleeve 21S is driven to rotate in a direction indicated by an arrow D31 in FIG. 3 by a non-illustrated driving device, and carries the developer on the circumferential surface of the sleeve 21S. The magnet 21M is a fixed magnet located inside of the sleeve 21S and having a plurality of magnetic poles arranged in the circumferential direction of the sleeve 21S. More specifically, the magnet 21M includes, though not shown, five magnetic poles which are S1 pole, N1 pole, S2 pole, N2 pole, and N3 pole, arranged in the circumferential direction. The S1 pole is located at an upper position of a forward portion of the magnet 21M, so as to oppose a layer regulator 60 to be subsequently described. The S1 pole serves as a regulating pole that regulates the developer layer. The N1 pole is located at an upper position of a rear portion of the magnet 21M. The N1 pole serves as a developing pole that supplies the toner to the photoconductor drum 31. The N2 pole is located at a lower position of the forward portion of the magnet 21M, so as to oppose the second stirring screw 24. The N2 pole serves as a catching pole that picks up the developer onto the developing roller 21. The S2 pole is located downstream of the N1 pole in the rotating direction of the sleeve 21S, and upstream of the N2 pole in the rotating direction of the sleeve 21S. The S2 pole is located at a lower position of the rear portion of the magnet 21M. The S2 pole serves as a conveying pole that conveys the developer containing the toner that has not been transferred to the photoconductor drum 31 by the N1 pole, to the developing unit housing 210. The N3 pole is located downstream of the S2 pole and upstream of the N2 pole, and serves to collect the developer carried by the sleeve 21S into the developing unit housing 210. The developer carried by the sleeve 21S is conveyed to an opening (not shown) formed in the developing unit housing 210, and the toner is supplied to the photoconductor drum 31 opposing the developing roller 21.

The internal space 220 in the developing unit housing 210 is covered with a non-illustrated top plate, and divided by a partition plate 22 extending in the left-right direction into a first conveying path 221 and a second conveying path 222 of a slender shape extending in the left-right direction. The first conveying path 221 is spaced from the developing roller 21, and the developer is conveyed in a first direction in the first conveying path 221. The second conveying path 222 is located between the developing roller 21 and the first conveying path 221, and the developer is conveyed in a second direction opposite to the first direction, in the second conveying path 222. The partition plate 22 is shorter than the width of the developing unit housing 210 in the left-right direction, and a first communication path 223 and a second communication path 224, each communicating between the first conveying path 221 and the second conveying path 222, are respectively provided on the left end portion and the right end portion of the partition plate 22. Thus, the first conveying path 221, the first communication path 223, the second conveying path 222, and the second communication path 224 constitute a circulation route (developer conveying path) in the internal space 220. The developer is conveyed counterclockwise in the circulation route in FIG. 4.

The toner inlet 25 is an opening perforated through the top plate, and located at an upper position in the vicinity of the left end portion of the first conveying path 221 (see FIG. 4). The toner inlet 25 is opposed to the circulation route, so as to introduce the refill toner supplied from the toner container 50 into the internal space 220. In this embodiment, the toner inlet 25 has dimensions of 14 mm×8 mm in a plan view.

The first stirring screw 23 is disposed in the first conveying path 221. The first stirring screw 23 includes a first rotary shaft 23*a* and a first helical blade 23*b* helically projecting from the circumferential surface of the first rotary shaft 23*a*. The first stirring screw 23 is driven by a non-illustrated driving device to rotate about the first rotary shaft 23*a* (arrow D33 in FIG. 3 and arrow R2 in FIG. 4), so as to convey the developer in the direction indicated by an arrow D1 (first direction) in FIG. 4. The first stirring screw 23 conveys the developer so as to cause the developer to pass the position where the toner inlet 25 opposes the first conveying path 221. Accordingly, the first stirring screw 23 mixes the new toner introduced through the toner inlet 25 with the developer being conveyed in the first conveying path 221, and delivers the mixed developer to the second conveying path 222. In this embodiment, the outer diameter of the first helical blade 23*b* is 25 mm, and the pitch of the blade in the axial direction is 20 mm. Although the pitch may vary depending on the conveying capability of the first stirring screw 23, it is preferable that the pitch is not narrower than 15 mm, in order to secure necessary conveying capability. A first puddle 23*c* is provided downstream of the first stirring screw 23 in the toner conveying direction (arrow D1). The first puddle 23*c* is a plate-shaped member attached to the first rotary shaft 23*a*. The first puddle 23*c* is made to rotate together with the first rotary shaft 23*a*, so as to deliver the developer from the first conveying path 221 to the second conveying path 222, as indicated by an arrow D3 in FIG. 4. In this embodiment, the first puddle 23*c* has a length of 10 mm in the axial direction.

The second stirring screw 24 is disposed in the second conveying path 222. The second stirring screw 24 includes a second rotary shaft 24*a* (rotary shaft) and a second helical blade 24*b* helically projecting from the circumferential surface of the second helical blade 24*b* (screw blade). The second stirring screw 24 is driven by a non-illustrated driving device to rotate about the second rotary shaft 24*a* (arrow D32 in FIG. 3 and arrow R1 in FIG. 4), so as to convey the developer in the direction indicated by an arrow D2 (second direction) in FIG. 4. The second stirring screw 24 serves to convey the developer in the second conveying path 222 and to supply the developer to the developing roller 21. In this embodiment, the outer diameter of the second helical blade 24*b* is 25 mm, and the pitch of the blade in the axial direction is 20 mm. Although the pitch may vary depending on the conveying capability of the second stirring screw 24, it is preferable that the pitch is not narrower than 15 mm, in order to secure necessary conveying capability.

The second stirring screw 24 is located at a lower position forward of the developing roller 21, so as to oppose the developing roller 21. The second stirring screw 24 is driven to rotate in the direction opposite to the rotating direction of the sleeve 21S of the developing roller 21 (arrow D32 in FIG. 3), in the region where the respective circumferential surfaces of the second stirring screw 24 and the developing roller 21 are closely opposed to each other. With the rotation of the second stirring screw 24, the developer is supplied to the sleeve 21S from the second stirring screw 24. The rotary shaft 24*a* of the second stirring screw 24 is located at a position lower than the shaft portion 21C of the developing roller 21. Further, the rotary shaft 24*a* of the second stirring screw 24 is located at a position lower than the lower end portion of the circumferential surface of the sleeve 21S. In this embodiment, the supply path of the toner from the second stirring screw 24 to the developing roller 21 is the only supply path of the toner to the developing roller 21. The second stirring screw 24 supplies the developer to the sleeve 21S at a first position P1 on the circumferential surface of the sleeve 21S of the developing roller 21, while being made to rotate downward with respect to the first position P1. The first position P1 is located a position lower than the shaft portion 21C of the developing roller 21.

A second puddle 24*c* is provided downstream of the second stirring screw 24 in the toner conveying direction (arrow D2). The second puddle 24*c* is a plate-shaped member attached to the second rotary shaft 24*a*. The second puddle 24*c* is made to rotate together with the second rotary shaft 24*a*, so as to deliver the developer from the second conveying path 222 to the first conveying path 221, as indicated by an arrow D4 in FIG. 4. In this embodiment, the second puddle 24*c* has a length of 10 mm in the axial direction.

The developing unit 20 further includes a layer regulator 60.

The layer regulator 60 is located at an upper position forward of the developing roller 21. The layer regulator 60 is disposed along the axial direction of the developing roller 21 so as to oppose the circumferential surface of the developing roller 21 (sleeve 21S). The layer regulator 60 is a plate-shaped member formed of a magnetic material. The layer regulator 60 has a rectangular shape having the longer sides extending toward the developing roller 21 in a cross-section orthogonal to the rotary shaft of the developing roller 21. The tip portion of the layer regulator 60 is spaced from the sleeve 21S of the developing roller 21, so as to define a layer regulating gap G between the tip portion and the sleeve 21S. The layer regulator 60 serves to regulate the layer thickness of the developer supplied from the second stirring screw 24 to the sleeve 21S. To be more detailed, the layer regulator 60 regulates the layer thickness of the developer at a second position P2 upper than the first position P1.

With the mentioned configuration according to this embodiment, the second stirring screw 24 supplies the developer to the sleeve 21S, at the first position P1 located in a portion of the circumferential surface of the sleeve 21S oriented downward. The layer regulator 60 regulates the layer thickness of the developer at the layer regulating gap G formed at the second position P2 upper than the first position P1 on the circumferential surface of the sleeve 21S. Further, the portion of the developer that has failed to intrude in the layer regulating gap G defined by the layer regulator 60 flows to the upstream side in the rotating direction of the sleeve 21S, and then falls onto the second stirring screw 24 located below (arrow D34 in FIG. 3).

Circumferential Velocity Ratio Between Developing Roller 21 and First Stirring Screw 24

In developing units that employ the two-component developer, generally, the circumferential velocity of the developing roller is set to be equal to or less than twice of that of the stirring screw, particularly in a range between a half and 1.5 times of the circumferential velocity of the stirring screw. Setting thus the circumferential velocity of the developing roller and that of the stirring screw to be close to each other allows a large amount of developer to be supplied to the developing roller, so that an abundant amount of developer is retained on the back side of the layer regulator. Accordingly, even though the amount of developer supplied to the developing roller fluctuates to a certain extent, the developer retained on the layer regulator can compensate the fluctuation, and therefore the amount of developer remaining beyond the layer regulator can be stably maintained.

On the other hand, on the back side of the layer regulator the friction among the developer particles increases, which accelerates the degradation of the developer. As a result of diligent studies, the inventors have discovered that the degradation of the developer depends, in particular, on the amount of the retained developer, rather than the circumferential velocity (rotation speed) of the developing roller. Therefore, in order to provide images of stable quality for a long period of time it is preferable that an appropriate amount of developer is supplied to the developing roller so as to suppress decline of image quality, and that the degradation of the developer in the vicinity of the layer regulator is suppressed.

In this embodiment, accordingly, the ratio between the circumferential velocity Vd of the developing roller 20 and the circumferential velocity Vs of the second stirring screw 24 is appropriately set. Specifically, the circumferential velocity Vd of the developing roller 20 and the circumferential velocity Vs of the second stirring screw 24 are determined so as to satisfy the condition of $2.0<Vd/Vs<7.0$ in this embodiment. With such a setting, a sufficient amount of developer can be supplied from the second stirring screw 24 to the developing roller 21, and therefore the amount of developer remaining beyond the layer regulator 60 can be prevented from becoming uneven.

In addition, the second stirring screw 24 includes the second rotary shaft 24*a* and the second helical blade 24*b* provided around the second rotary shaft 24*a*. Accordingly, even though the developer supplying performance from the second stirring screw 24 to the developing roller 21 partially varies depending on the pitch of the second helical blade 24*b*, density difference in the axial direction of the developing roller 21 can be suppressed, and also density difference originating from the pitch of the second helical blade 24*b* of the second stirring screw 24 (oblique color belt) can be suppressed. Further, the developer retained in the vicinity of the layer regulator 60 is exempted from suffering an excessive load because of an excessive amount of developer being supplied from the second stirring screw 24 to the developing roller 21, and therefore progress of degradation of the developer is suppressed.

Working Example

Hereunder, working examples of the disclosure will be described, however it is to be understood that the disclosure is in no way limited to the following working examples. The working examples described below are based on the following settings.

- Type of photoconductor drum 31: OPC drum
- Circumferential velocity of photoconductor drum 31: 146 mm/sec
- Thickness regulating gap G: 0.3 mm
- AC component of developing bias: Square wave amplitude 1.2 kV, Duty 50%
- DC component of developing bias: 300V
- Surface potential of photoconductor drum 31 (background area/image area): 430V/60V
- Diameter of photoconductor drum 31: 24 mm
- Diameter of developing roller 21: 16 mm
- Diameter of second stirring screw 24: 25 to 26 mm
- Average particle diameter of non-magnetic toner: 6.5 m (D50)

Average particle diameter of magnetic toner: 35 m (D50)
Amount of developer in the developing unit housing 210: 350 g
Toner density: 12%

Experiment Method

Figure 5:
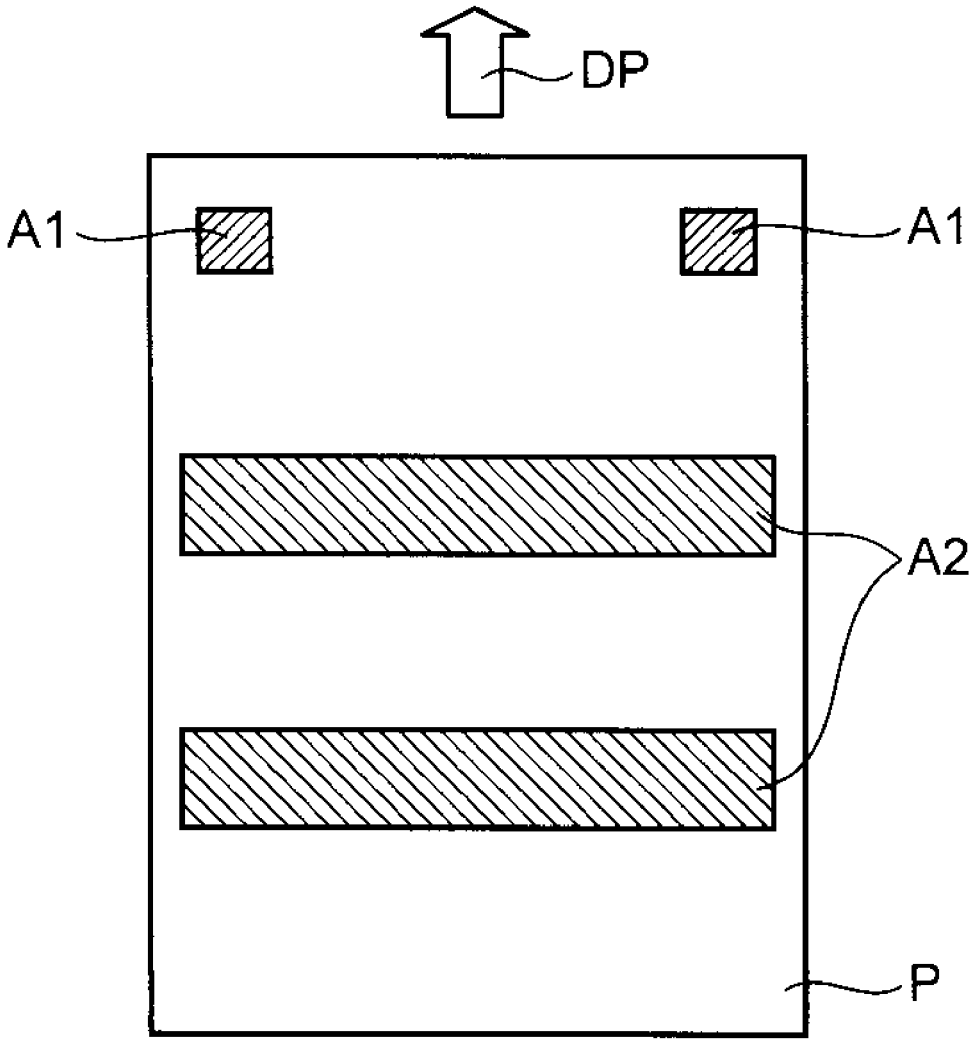
FIG. 5 is a schematic drawing showing a sample image for consuming the developer.

Tables 1, 2, and 3 cited below show individual settings of experiment sessions 1 to 27. In each of the sessions the circumferential velocity Vd of the developing roller 20 and the circumferential velocity Vs of the second stirring screw 24 were varied, and decline in image density and density difference between left and right images were evaluated under different circumferential velocity ratios (Vd/Vs). For each session, 300 sheets of sample image pattern shown in FIG. 5 were printed in advance. The sample image has a black/white (B/W) ratio of 20%. In FIG. 5, regions A1 are patches for image density measurement, and regions A2 are patches for toner consumption. The regions A1 are formed on the respective end portions of a sheet P in the width direction and in the vicinity of the leading edge, in a size of 10 mm square. The regions A2 are each formed in a strip shape. Upon preliminarily printing the 300 sheets, the density of the regions A1 was measured as initial image density. Thereafter, durability test was performed in which an image having a B/W ratio of 1% was printed on 10,000 sheets in an intermittent mode, and the image density was measured again after printing 10,000 sheets.

In Tables 1 to 3, a cross in columns of "image density decline" denotes that the measured density (I.D) was below 1.0, a triangle denotes the case of 1.0≤I.D<1.1, and a circle denotes the case of 1.1≤I.D. The density difference between left and right images refer to the density difference between the patches of the region A1 in FIG. 5, and a circle is given in the case of 0≤density difference<0.1, a triangle is given in the case of 0.1≤density difference<0.2, and a cross is given in the case of 0.2≤density difference.

Decline of the image density originates from decline in chargeability of the developer due to degradation of the developer. Accordingly, smaller decline in image density reflects less degradation of the developer. The density difference between left and right images originates from insufficient developer supply to the developing roller 21 on the downstream side in the conveying direction of the second stirring screw 24 (arrow D2 in FIG. 4), which creates density difference between the patches. In other words, suppression of the density difference between left and right images can be achieved by properly maintaining the amount of the developer supplied to the developing roller 21.

Table 1 shows the results of the sessions in which the circumferential velocity Vd of the developing roller 21 was set at 276 mm/sec and the circumferential velocity Vs of the second stirring screw 24 was varied to different values.

TABLE 1

| | | | Experiment Session No. | | | | | | | | | | | | | | |
|---|---|---|---|---|---|---|---|---|---|---|---|---|---|---|---|---|---|
| | | | 1 | 2 | 3 | 4 | 5 | 6 | 7 | 8 | 9 | 10 | 11 | 12 | 13 | 14 | 15 |
| Developing Roller | Diameter | mm | 16 | 16 | 16 | 16 | 16 | 16 | 16 | 16 | 16 | 16 | 16 | 16 | 16 | 16 | 16 |
| | Rotation speed | rpm | 330 | 330 | 330 | 330 | 330 | 330 | 330 | 330 | 330 | 330 | 330 | 330 | 330 | 330 | 330 |
| | Circumferential velocity | mm/s | 276 | 276 | 276 | 276 | 276 | 276 | 276 | 276 | 276 | 276 | 276 | 276 | 276 | 276 | 276 |
| Second stirring screw | Diameter | mm | 25 | 25 | 25 | 25 | 25 | 25 | 25 | 25 | 25 | 25 | 25 | 25 | 25 | 25 | 25 |
| | Rotation speed | rpm | 30 | 31 | 34 | 35 | 37 | 41 | 43 | 45 | 57 | 68 | 77 | 99 | 106 | 142 | 170 |
| | Circumferential velocity | mm/s | 39 | 41 | 45 | 45 | 48 | 54 | 56 | 59 | 74 | 89 | 100 | 130 | 138 | 186 | 223 |
| Circumferential velocity ratio of developing roller to second stirring screw (Vd/Vs) | | | 7.1 | 6.8 | 6.2 | 6.1 | 5.7 | 5.1 | 4.9 | 4.6 | 3.7 | 3.1 | 2.8 | 2.1 | 2.0 | 1.5 | 1.2 |
| Image density decline | | | ○ | ○ | ○ | ○ | ○ | ○ | ○ | ○ | ○ | ○ | Δ | Δ | X | X | X |
| Density difference between left and right images | | | X | Δ | Δ | Δ | Δ | Δ | ○ | ○ | ○ | ○ | ○ | ○ | ○ | ○ | ○ |

Table 2 shows the results of the sessions in which the circumferential velocity Vd of the developing roller 21 was set at 207 mm/sec and the circumferential velocity Vs of the second stirring screw 24 was varied to different values.

TABLE 2

| | | | Experiment Session No. | | | | | |
|---|---|---|---|---|---|---|---|---|
| | | | 16 | 17 | 18 | 19 | 20 | 21 |
| Developing Roller | Diameter | mm | 16 | 16 | 16 | 16 | 16 | 16 |
| | Rotation speed | rpm | 247 | 247 | 247 | 247 | 247 | 247 |
| | Circumferential velocity | mm/s | 207 | 207 | 207 | 207 | 207 | 207 |
| Second stirring screw | Diameter | mm | 25 | 25 | 25 | 25 | 26 | 25 |
| | Rotation speed | rpm | 21 | 23 | 29 | 43 | 72 | 99 |
| | Circumferential velocity | mm/s | 27 | 30 | 38 | 59 | 94 | 130 |
| Circumferential velocity ratio of developing roller to second stirring screw (Vd/Vs) | | | 7.5 | 6.9 | 5.5 | 3.5 | 2.2 | 1.6 |
| Image density decline | | | ○ | ○ | ○ | ○ | Δ | X |
| Density difference between left and right images | | | X | Δ | Δ | ○ | ○ | ○ |

Table 3 shows the results of the sessions in which the circumferential velocity Vd of the developing roller 21 was set at 167 mm/sec and the circumferential velocity Vs of the second stirring screw 24 was varied to different values.

TABLE 3

| | | | Experiment Session No. | | | | | |
|---|---|---|---|---|---|---|---|---|
| | | | 22 | 23 | 24 | 25 | 26 | 27 |
| Developing Roller | Diameter | mm | 16 | 16 | 16 | 16 | 16 | 16 |
| | Rotation speed | rpm | 200 | 200 | 200 | 200 | 200 | 200 |
| | Circumferential velocity | mm/s | 167 | 167 | 167 | 167 | 167 | 167 |
| Second stirring screw | Diameter | mm | 25 | 25 | 25 | 25 | 25 | 26 |
| | Rotation speed | rpm | 18 | 19 | 26 | 40 | 61 | 68 |
| | Circumferential velocity | mm/s | 23 | 25 | 33 | 52 | 80 | 93 |
| Circumferential velocity ratio of developing roller to second stirring screw (Vd/Vs) | | | 7.2 | 6.8 | 5.0 | 3.2 | 2.1 | 1.8 |
| Image density decline | | | ○ | ○ | ○ | ○ | Δ | X |
| Density difference between left and right images | | | X | Δ | ○ | ○ | ○ | ○ |

As shown in Tables 1 to 3, in the case where the circumferential velocity ratio Vd/Vs between the developing roller 21 and the second stirring screw 24 satisfies the condition of 2.0<Vd/Vs<7.0, decline in image density was suppressed and increase in density difference between left and right images was suppressed. In other words, the developer was stably supplied from the second stirring screw 24 to the developing roller 21, and a minimum necessary amount of developer was retained on the back side of the layer regulator 60, and therefore degradation of the developer was effectively prevented. In addition, in the cases where the circumferential velocity ratio Vd/Vs was larger than 3.0, the developer was more effectively kept from suffering an excessive load in the vicinity of the layer regulator, and therefore degradation of the developer as well as the decline in image density was further suppressed. In the cases where Vd/Vs was equal to or larger than 5.0, the supply of the developer to the developing roller 21 was stably maintained, and the density difference between left and right images was more effectively suppressed.

In the foregoing embodiment, the second stirring screw 24 supplies the developer to the developing roller 21 at the first position P1 located on the circumferential surface of the developing roller 21 below the shaft portion 21C, in a cross-sectional view taken orthogonally to the axial direction (second direction) of the second rotary shaft 24*a* of the second stirring screw 24, as shown in FIG. 3. In addition, the layer regulator 60 regulates the layer thickness of the developer at the second position P2 located upper than the first position P1 on the circumferential surface of the developing roller 21. Such configurations allow the advantageous effects expected from the circumferential velocity ratio Vd/Vs between 2.0 and 7.0 to be prominently exhibited. In other words, an excess of the developer retained on the back side (front side and lower side) of the layer regulator 60 can fall onto the second stirring screw 24 located below, as indicated by the arrow D34 in FIG. 3. In other configurations in which the layer thickness of the developer is regulated at a position lower than the first position P1 on the circumferential surface of the developing roller 21, there is no room for the retained developer to escape, and hence the developer is prone to be degraded. Thus, the location of the layer regulator 60 and the setting of the circumferential velocity ratio Vd/Vs according to the embodiment effectively suppress degradation of the two-component developer and unevenness of the image density (density difference).

In the foregoing embodiment, further, the second stirring screw 24 supplies the developer to the developing roller 21 while being made to rotate downward in the region where the second stirring screw 24 is opposed to the developing roller 21 (see FIG. 3). Accordingly, an excess of the developer falls off owing to the gravity in the region where the second stirring screw 24 is opposed to the developing roller 21. Such a configuration more securely prevents excessive supply of the developer to the developing roller 21.

As described above, the image forming apparatus 1 according to the foregoing embodiment prevents uneven supply of the developer regulated by the layer regulator 60, to thereby suppress decline in density of an image formed on a sheet originating from degradation of the developer. In addition, density difference in a part of an image originating from improper supply of the developer to the developing roller 21 can be suppressed.

Various modifications and alterations of this disclosure will be apparent to those skilled in the art without departing from the scope and spirit of this disclosure, and it should be understood that this disclosure is not limited to the illustrative embodiments set forth herein.

What is claimed is:

1. A developing unit comprising:

a casing that stores therein a two-component developer containing a toner and a carrier;

a developer carrier located in the casing and including a shaft portion, the developer carrier being configured to be driven to rotate and to carry the developer on a circumferential surface of the developer carrier;

a developer conveying path located in the casing, and including a first conveying path spaced from the developer carrier and configured to convey the developer in a first direction, and a second conveying path located between the developer carrier and the first conveying path and configured to convey the developer in a second direction opposite to the first direction, the developer conveying path being configured to circulate the developer between the first conveying path and the second conveying path;

a developer conveying member includes a rotary shaft and a screw blade provided around the rotary shaft, disposed in the second conveying path such that a circumferential surface of the developer conveying member opposes the circumferential surface of the developer carrier with a prescribed space, and configured to be driven to rotate such that the circumferential surface of the developer conveying member moves in a direction opposite to a moving direction of the circumferential surface of the developer carrier in a region where the respective circumferential surfaces of the developer conveying member and the developer carrier are opposed to each other with the prescribed space, so as to convey the developer in the second direction and to supply the developer to the developer carrier; and a layer thickness regulator spaced from the circumferential surface of the developer carrier, and configured to regulate a layer thickness of the developer supplied to the developer carrier, wherein the developing unit is configured to satisfy a condition of $2.0<Vd/Vs<7.0$ and Vd is set to be ≥167 mm/sec and ≤276 mm/sec, where Vd denotes a circumferential velocity of the developer carrier and Vs denotes a circumferential velocity of the developer conveying member, the developer conveying member supplies the developer to the developer carrier while the circumferential surface of the developer conveying member is made to rotate so as to move toward the developer carrier from upward to downward in a region where the developer conveying member is opposed to the developer carrier, the developer conveying member supplies the developer to the developer carrier at a first position on the circumferential surface of the developer carrier below the shaft portion, in a cross-sectional view taken so as to intersect the second direction, and the layer thickness regulator regulates a layer thickness of the developer at a second position above the first position on the circumferential surface of the developer carrier.

2. The developing unit according to claim 1, configured to satisfy a condition of $3.0<Vd/Vs<7.0$.

3. The developing unit according to claim 1, configured to satisfy a condition of $2.0<Vd/Vs\leq5.0$.

4. An image forming apparatus comprising:

an image carrier configured to carry a static latent image formed on a surface thereof, a developing unit configured to develop the static latent image formed on the image carrier thereby forming a toner image; and a transfer unit configured to transfer the toner image formed on the image carrier, wherein the developing unit includes:

a casing that stores therein a two-component developer containing a toner and a carrier;

a developer carrier located in the casing and including a shaft portion, the developer carrier being configured to be driven to rotate and to carry the developer on a circumferential surface of the developer carrier;

a developer conveying path located in the casing, and including a first conveying path spaced from the developer carrier and configured to convey the developer in a first direction, and a second conveying path located between the developer carrier and the first conveying path and configured to convey the developer in a second direction opposite to the first direction, the developer conveying path being configured to circulate the developer between the first conveying path and the second conveying path;

a developer conveying member includes a rotary shaft and a screw blade provided around the rotary shaft, disposed in the second conveying path such that a circumferential surface of the developer conveying member opposes the circumferential surface of the developer carrier with a prescribed space, and configured to be driven to rotate such that the circumferential surface of the developer conveying member moves in a direction opposite to a moving direction of the circumferential surface of the developer carrier in a region where the respective circumferential surfaces of the developer conveying member and the developer carrier are opposed to each other with the prescribed space, so as to convey the developer in the second direction and to supply the developer to the developer carrier; and a layer thickness regulator spaced from the circumferential surface of the developer carrier, and configured to regulate a layer thickness of the developer supplied to the developer carrier, wherein the developing unit is configured to satisfy a condition of $2.0<Vd/Vs<7.0$ and Vd is set to be ≥167 mm/sec and ≤276 mm/sec, where Vd denotes a circumferential velocity of the developer carrier and Vs denotes a circumferential velocity of the developer conveying member, the developer conveying member supplies the developer to the developer carrier while the circumferential surface of the developer conveying member is made to rotate so as to move toward the developer carrier from upward to downward in a region where the developer conveying member is opposed to the developer carrier, the developer conveying member supplies the developer to the developer carrier at a first position on the circumferential surface of the developer carrier below the shaft portion, in a cross-sectional view taken so as to intersect the second direction, and the layer thickness regulator regulates a layer thickness of the developer at a second position above the first position on the circumferential surface of the developer carrier.

* * * * *